US005276285A

United States Patent [19]

Pham et al.

[11] Patent Number: 5,276,285

[45] Date of Patent: Jan. 4, 1994

[54] HIGH RUPTURE CAPACITY CIRCUIT-BREAKER

[75] Inventors: Van Doan Pham, Meyzieu; Robert Jeanjean, Lyons; Joseph Martin, Meyzieu; Robert Isbister, Lyons, all of France

[73] Assignee: GEC Alsthom SA, Paris, France

[21] Appl. No.: 883,364

[22] Filed: May 15, 1992

[30] Foreign Application Priority Data

May 17, 1991 [FR] France ..... 91 06033

[51] Int. Cl.[5] ..... H01H 33/16

[52] U.S. Cl. ..... 200/144 AP; 200/148 A

[58] Field of Search ..... 200/144; 338/20, 21

[56] References Cited

U.S. PATENT DOCUMENTS

| | | | |
|---|---|---|---|
| 2,724,755 | 11/1955 | Morgan | 200/145 |
| 3,745,505 | 7/1973 | Turnbull et al. | 338/20 |
| 4,338,500 | 7/1982 | Pham et al. | 200/144 AP |
| 4,434,332 | 2/1984 | Yanabu et al. | 200/144 AP |
| 4,439,651 | 3/1984 | Thuries et al. | 200/144 AP |
| 5,164,559 | 11/1992 | Pham et al. | 200/144 AP |
| 5,170,023 | 12/1992 | Pham et al. | 200/144 AP |

FOREIGN PATENT DOCUMENTS

| | | |
|---|---|---|
| 0078418 | 5/1983 | European Pat. Off. . |
| 0117914 | 9/1984 | European Pat. Off. . |
| 0414192 | 2/1991 | European Pat. Off. . |
| 2835064 | 2/1980 | Fed. Rep. of Germany . |
| 669863 | 4/1989 | Fed. Rep. of Germany . |
| 2653611 | 4/1991 | France . |
| 2654251 | 5/1991 | France . |
| 665053 | 4/1988 | Switzerland . |

OTHER PUBLICATIONS

IEEE Transactions on Power Apparatus and Systems, vol. PAS99, No. 1, Jan., 1980, New York, U.S., pp. 69–77; H. E. Gallagher et al.: "145-kV Current Limiting Device–Field Tests".

*Primary Examiner*—J. R. Scott

*Attorney, Agent, or Firm*—Sughrue, Mion, Zinn, Macpeak & Seas

[57] ABSTRACT

A high-voltage circuit-breaker has an interrupting chamber comprising a gas-tight cylindrical casing filled with a gas having good insulative properties such as sulfur hexafluoride. The casing contains a fixed permanent contact, a fixed arc contact and a mobile assembly comprising permanent contacts and arc contacts and associated with a gas blast assembly. The chamber also contains a carbon-based resistor having a resistance of approximately 500 ohms connected in parallel with the circuit-breaker contacts when the arc contacts are opened by an auxiliary switch. This resistor is connected in series with an arrangement of varistors, the resulting combination being disposed inside the casing and connected in series with the auxiliary switch. Opening of the auxiliary switch is effected by opening of the circuit-breaker. The volume of the resistor is greater than that of the arrangement of varistors by a factor of at least five.

10 Claims, 6 Drawing Sheets

HIGH RUPTURE CAPACITY CIRCUIT-BREAKER

BACKGROUND OF THE INVENTION

1. Field of the invention

The invention concerns a high-voltage circuit-breaker with an interrupting chamber comprising a gas-tight casing filled with a gas having good insulative properties such as sulfur hexafluoride and containing a fixed permanent contact, a fixed arc contact and a mobile assembly comprising permanent contacts and arc contacts, the chamber further comprising a shunt resistor connected by an auxiliary switch when the arc contacts are opened.

2. Description of the prior art

In single-interrupter type very high voltage circuit-breakers the conditions for interrupting line fault currents are very severe.

It is known to insert a breaking resistor R to improve line fault current interrupting. The presence of a resistor whose resistance value is approximately equal to the line impedance Z strongly reduces the rate of increase of the transient voltage and the amplitude of the first peak of oscillation of the line voltage. The reduction coefficient is equal to $R/(R+Z)$ and $Z=450$ ohms for an overhead line. These interrupting resistors cannot be kept live for long because they absorb a large amount of energy. It is therefore necessary to associate with them a switch which must have a high rupture capacity to interrupt the residual current, especially under phase opposition conditions.

For currents exceeding several hundred amperes a gas-blast type switch is required, the relaxation time the time for which the current is regarded as negligible, being less than 1 ampere, for example is very short. This leads to the installation of complex pressurized gas auxiliary switches.

It is also known to use series varistors inserted during the interrupting operation.

A capacitor in parallel with these varistors improves the interruption of high line fault currents. For capacitors having a capacitance exceeding 5,000 pF this arrangement, although effective, is costly. The capacitor must be rated to withstand the phase opposition voltage for approximately one period of the voltage. Although this time is short, the capacitor is large. An arrangement of this kind is described in French patent application Fr 91 04173.

French patent application Fr 91 04173 describes very simple auxiliary switches requiring no gas blast for varistor-assisted interruption.

The present invention makes it possible to interrupt high resistive currents with auxiliary switches of this kind with no insulative gas blast.

SUMMARY OF THE INVENTION

The invention consists in a high-voltage circuit-breaker having an interrupting chamber comprising a gas-tight cylindrical casing filled with a gas having good insulative properties such as sulfur hexafluoride and containing a fixed permanent contact, a fixed arc contact and a mobile assembly comprising permanent contacts and arc contacts and associated with gas blast means, the chamber also containing a carbon-based resistor having a resistance of approximately 500 ohms connected in parallel with the circuit-breaker contacts when the arc contacts are opened by an auxiliary switch, in which circuit-breaker said resistor is connected in series with an arrangement of varistors the combination being disposed inside said casing and connected in series with said auxiliary switch opening of which is commanded by opening of said circuit-breaker, the volume of said resistor being greater than that of said arrangement of varistors by a factor of at least five.

A varistor is a voltage-dependent resistor. For the varistor arrangement $I=kV^{\alpha}$. For a voltage of 1 p.u. $(U_n/\sqrt{3})$ in many applications the current in the varistor remains very low or even negligible. This is equivalent to a substantially infinite resistance. The varistor passes a high current only if the voltage exceeds $(U_n/\sqrt{3})$. In this case, R tends towards a value of several hundred ohms, for example.

The varistor limits the voltage when the latter exceeds a particular threshold.

The resistor has a fixed value and $I=U/R$. For $U=(U_n/\sqrt{3})$, with $R=500$ ohms, the current is already high (in the order of several hundred amperes).

The resistor is used to facilitate interruption, in particular line fault current interruption, and not to limit the high voltage.

As will emerge from the following description, adding the varistor arrangement to the resistor has a two-fold purpose: it yields a relaxation time which eliminates the need for a complex gas blast type auxiliary switch and its inherent capacitance enables the resistor to fulfil its role relative to the mains switch, which role is to facilitate interruption.

In the case of ZnO type varistors the varistor arrangement comprises varistors in parallel.

To obtain minimal overall dimensions the varistor arrangement preferably comprises stacked varistor pads, groups of varistors being separated by conductive disks having a radial tab, the latter being connected together by a sheathed conductor.

In the case of SiC type varistors the varistor arrangement comprises varistors stacked in series.

To increase the capacitance between the terminals of the varistor arrangement a capacitor may be connected in parallel with the varistor arrangement.

In an advantageous embodiment the varistor pads and optionally the conductive disks are annular, an insulative tube is inserted into the hole formed by the stacked varistor pads and the capacitor is disposed in this hole and connected in parallel with the varistors by at least one conductor.

In a final embodiment a varistor is connected in series with the capacitor to reduce the residual current.

By virtue of the invention a particularly simple switch with no gas blast may be used.

The inserter mechanism preferably comprises at least one metal arm electrically connected to the resistor and cooperating with an electrode electrically connected to the second terminal.

The invention is described in more detail hereinafter with reference to the drawings which show preferred embodiments of the invention.

DETAILED DESCRIPTION OF THE INVENTION

Figure 1:
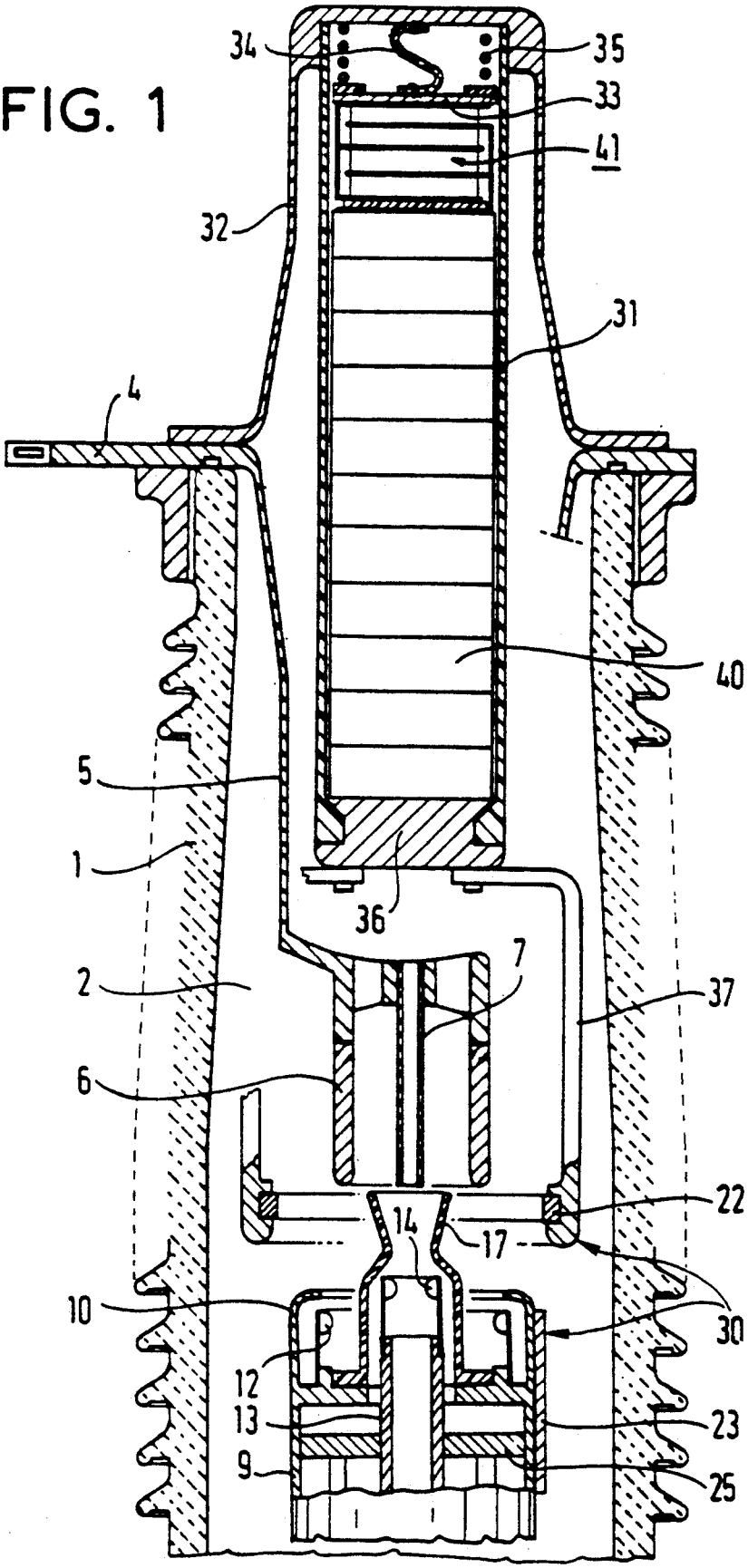
FIG. 1 is a view of a circuit-breaker in accordance the invention in longitudinal cross-section.

Referring to FIG. 1, an insulative casing 1, preferably of porcelain, delimits a volume 2 containing the interrupter devices of the circuit-breaker. The insulative casing is closed at one end by a metal cap 32 fixed to a metal ring 4 constituting a first terminal and is extended inside the casing by arms 5 to which are fixed a first metal tube 6 constituting the fixed main contact and a second tube 7 coaxial with the first and constituting the fixed arc contact.

The volume 2 is filled with a gas having good insulative properties such as sulfur hexafluoride at a pressure of a few bars.

The mobile assembly of the circuit-breaker comprises a metal tube 9 extended by an anti-discharge cap 10 and provided with a transverse metal bulkhead carrying contact fingers 12 constituting the mobile main contact and a gas blast tube 13 extended by contact fingers 14 constituting the mobile arc contact. The bulkhead incorporates holes for the gas blast to pass through and carries an insulative material gas blast nozzle 17. The gas blast is provided by a fixed piston 25 disposed inside the tube 9 which is connected by sliding contacts (not shown) to a second terminal of the circuit-breaker.

The resistor associated with the interrupting chamber is accommodated inside the chamber. It comprises a stack of resistor elements 40 disposed in an insulative tube 31. The resistor elements 40 are usually carbon-based pads.

An arrangement 41 of varistors optionally with an associated capacitor is also disposed in the tube 31. The varistor elements may be of the zinc oxide (ZnO) or silicon carbide (SiC) type.

This arrangement will be described in more detail later.

The tube 31 is fixed to the upper part of the metal cap 32 closing the upper end of the interrupting chamber. On top of the stack of elements is a metal plate 33 connected by a braided conductor 34 to the cap 32 and pressed against the end of the cap by a spring 35.

The lower part of the tube 31 is in the form of a metal block 36 carrying arms 37 to the end of which is fixed a metal (copper or tungsten (wolfram)) ring 22 cooperating with an electrode 23 attached to the tube 9 for the purpose of inserting the resistor and varistor arrangement.

The arrangement 41 can instead be disposed between the resistor 40 and the metal block 36. This protects against heat dissipated by the resistor.

Figure 2:
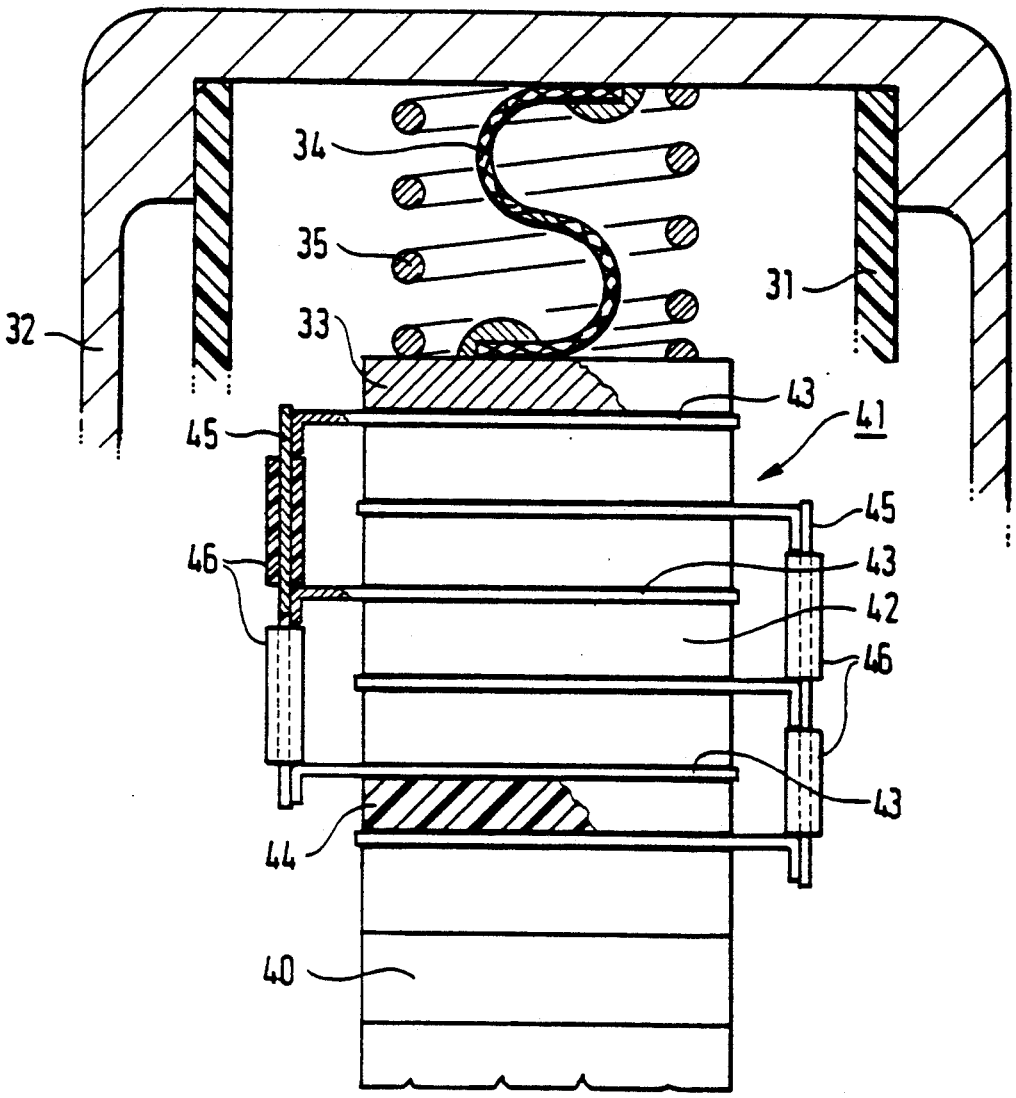
FIG. 2 is a detail view in longitudinal cross-section showing the varistor arrangement associated with the resistor in a first embodiment.

FIG. 2 shows a first embodiment of the arrangement 41 of varistors 42 associated in parallel in series with the stack of resistor pads 40.

The varistors 42 are cylindrical pads stacked with conductive disks 43 between them.

Figure 3:
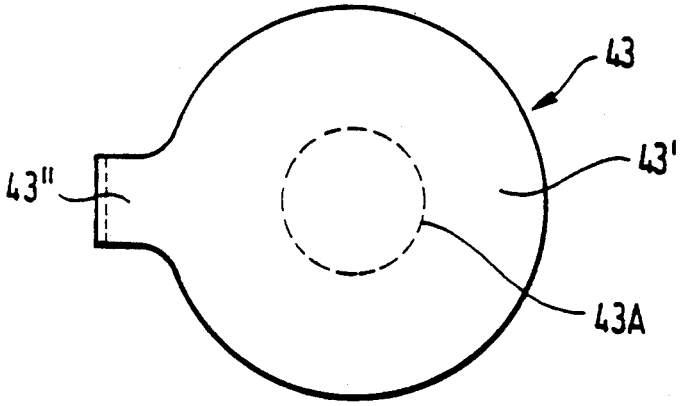
FIG. 3 is a top view of a conductive member used in this embodiment.

One conductive disk 43 is shown in FIG. 3. It is a metal disk 43 with a radial tab 43, bent at 90° at its free end. A disk of this kind is also fitted to the top resistor pad 40, with an insulative disk 44 on top of it, another disk 43 being disposed between the insulative disk 44 and the bottom varistor pad. There is also a conductive disk 43 under the metal plate 33 on top of the top varistor pad.

In this example there are four varistor pads 42.

The tabs 43′ of the disks 43 are disposed alternately on one side and the other of the stack of varistors. The tabs 43″ on the same side are connected together by a braided conductor 45 fitted with an insulative sheath 46 in the parts not connected to a tab 43″. The varistors 42 are therefore connected in parallel to the output of the resistor, with minimum overall dimensions.

Figure 4:
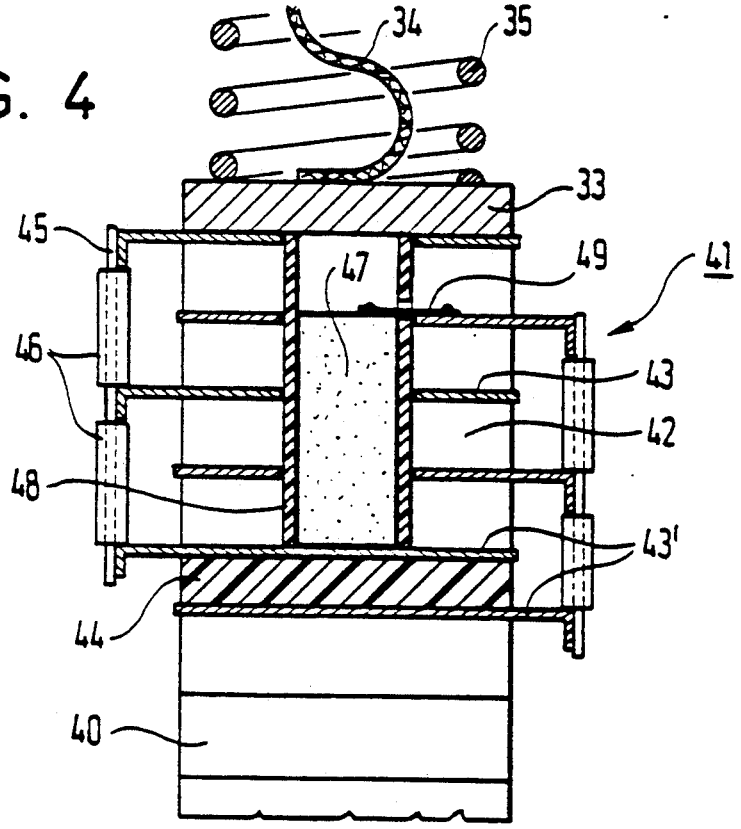
FIGS. 4 and 5 are views analogous to that of FIG. 2 in which a capacitor optionally in series with a varistor is connected in parallel with the varistors in a second and a third embodiment.

FIG. 4 is an analogous view of a second embodiment in which a capacitor 47 is connected in parallel with the varistors 42.

To this end the varistors 42 are annular. An insulative tube 48 is inserted into the hole formed by the stack of varistors 42 and the capacitor 47 is disposed inside the insulative tube 48.

The conductive disks 43 are also annular, and have a central orifice 43A, FIG. 3 which is substantially the same size as that of the varistors 42. The bottom disks 43′ on either side of the insulative disk 44 are solid. The capacitor 47 is thereby connected in parallel with the varistors 42 by means of an interleaved conductor 49.

Figure 5:
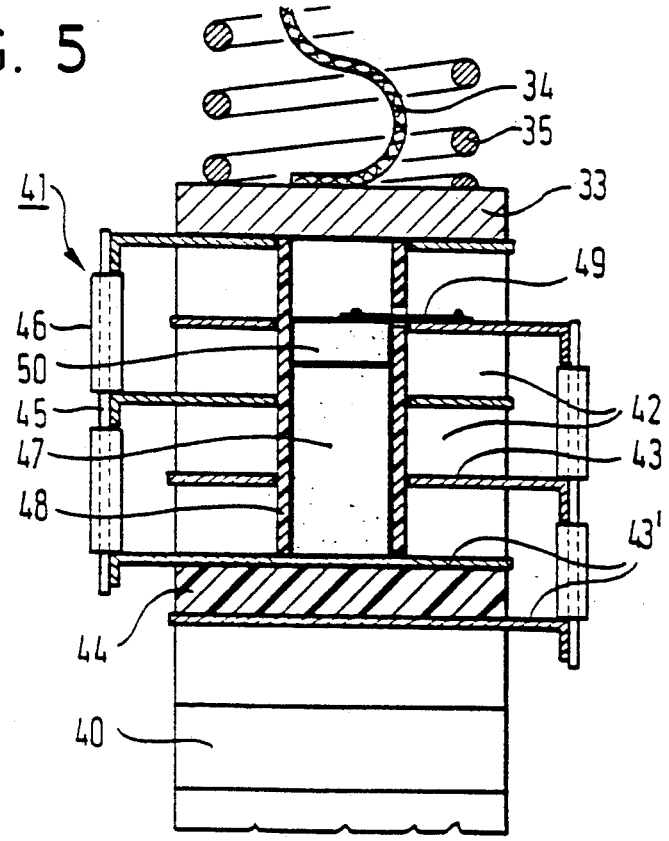

FIG. 5 is an analogous view of a third embodiment in which a varistor 50 is connected in series with the capacitor 47.

Figure 6:
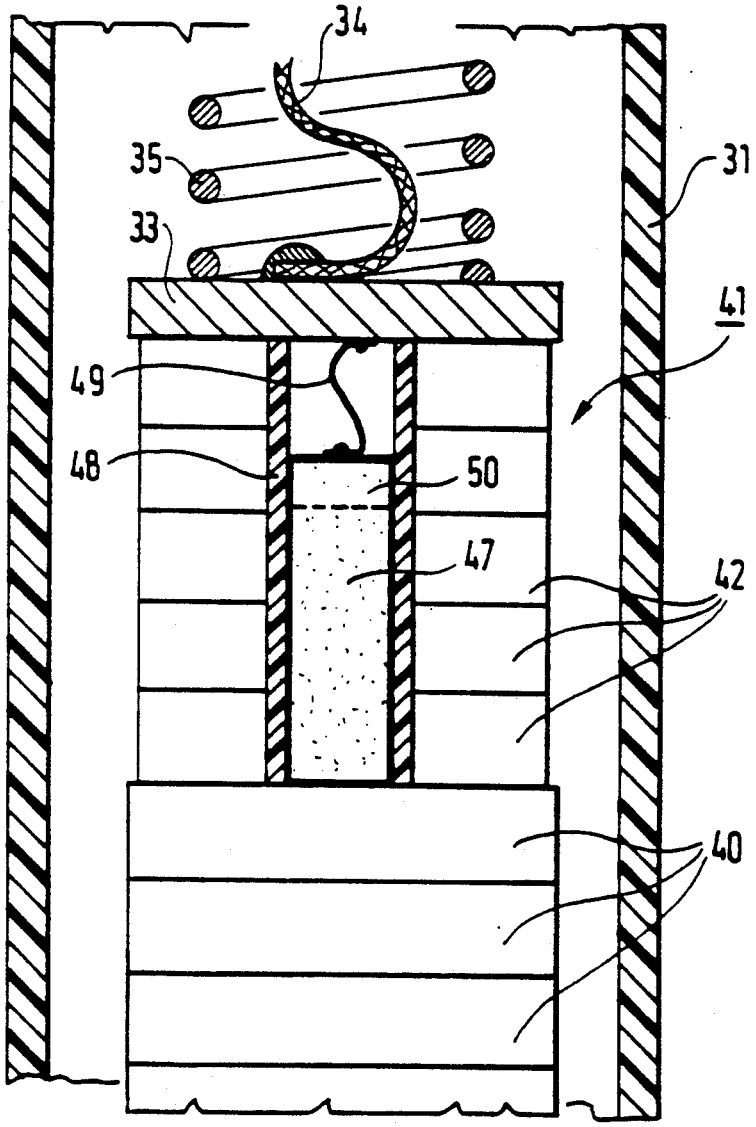
FIG. 6 is a detail view in longitudinal cross-section showing a varistor arrangement associated with a resistor in a fourth embodiment.

FIG. 6 is a view in cross-section of a fourth embodiment in which the varistors 42 are connected in series with the resistors 40 and the capacitor 47 is connected in parallel with the varistors 42. In this case, the annular varistors 42 are stacked directly on the resistors 40 and the capacitor 47 is inside an insulative tube 48 associated with a conductor 49 and optionally with a varistor 50.

Figure 7:
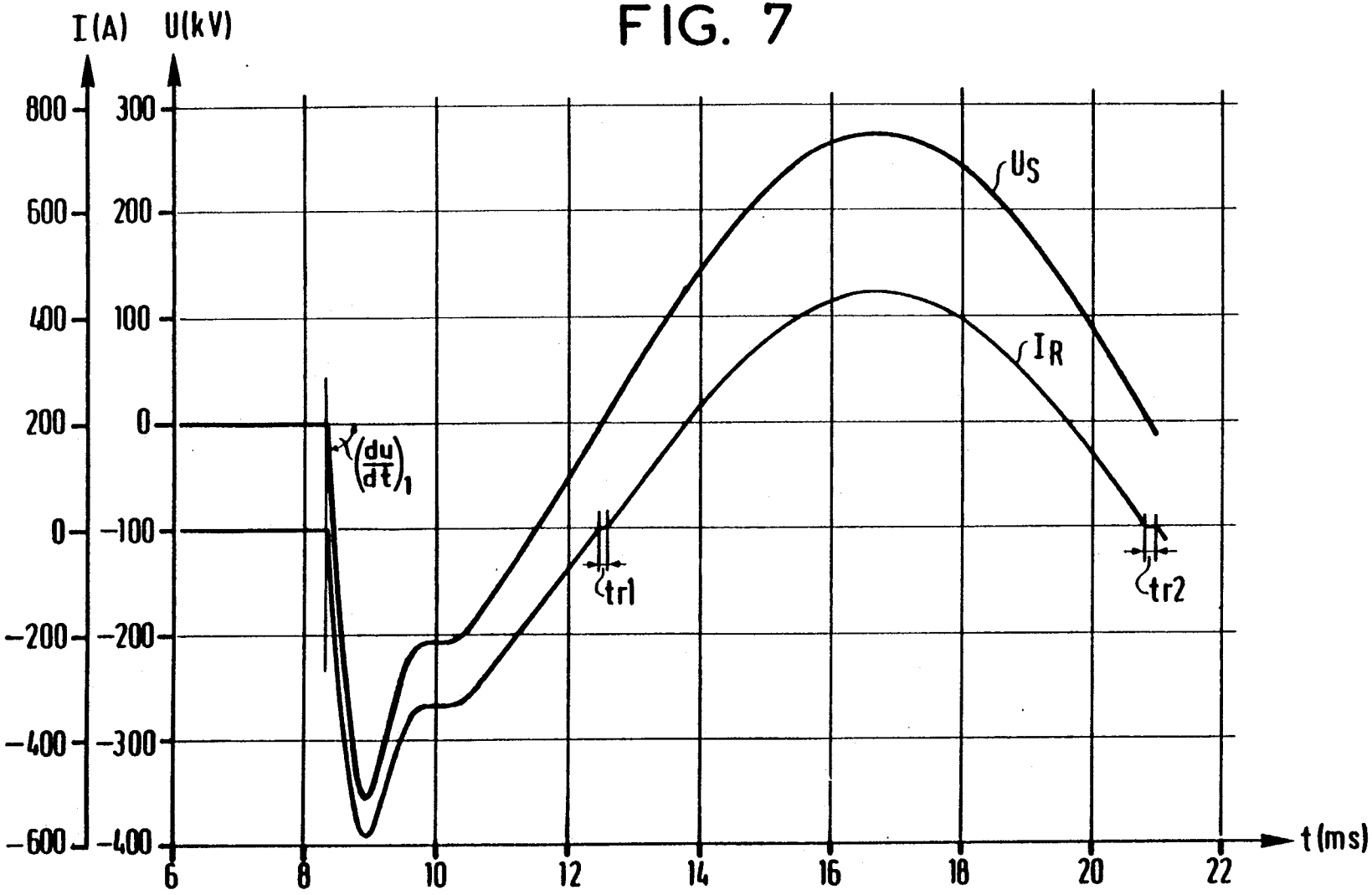
FIG. 7 is a diagram showing voltage and current as a function of time illustrating the operation of a circuit-breaker in accordance with the invention on interrupting current at the arc contacts.

The operation of these arrangements will now be described with reference to FIG. 7.

The circuit-breaker has a breaking resistor R associated with varistor elements V and optionally with a capacitor in the embodiments described above.

On interrupting a line fault current, when the high current in the main chamber is turned off, a transient voltage with a very high rate of increase $(du/dt)_0$, exceeding 10 kV/μs, appears between the arc contact terminals and at the same time across the auxiliary circuit, the auxiliary switch being closed. Given the very high line oscillation frequency $F \geqq 100$ kHZ, the varistors V are short-circuited and the capacitor C has an impedance which is low in comparison with the resistance of the resistor R. The rate of increase of the transient voltage applied to the circuit-breaker is reduced in the ratio $R/(R+Z)$ or 0.5 if $R=Z$.

Thus $(du/dt)_1 = 0.5 \times (du/dt)_0$.

The amplitude of the first oscillation peak of the line voltage and du/dt are therefore reduced which improves the line fault current interrupting conditions.

In the case of zinc oxide varistors at low voltage and high frequency, the capacitive component is preponderant and it may not be indispensable to insert an additional capacitor in the first embodiment, FIG. 2. If a capacitor is connected in parallel, this is done as in the second embodiment, FIG. 4.

In the case of silicon carbide varistors, whose inherent capacitance is very low, the resistive component is preponderant at low voltage and high frequency. It is therefore necessary to add an additional capacitor C in the second or fourth embodiment in parallel with the varistors. The capacitor C has a relatively low value such as a few thousand picofarads.

The parallel connection of the varistors V makes it possible to pass a current of several hundred amperes for around one period at 50 Hz of approximately 20 ms. Given that a ZnO varistor element has a capacitance in the order of 2,000 pF, the capacitance with disks in parallel will be $n \times 2{,}000$ pF.

SiC varistors have a high thermal capacity. They may be connected only in series, fourth embodiment, FIG. 6.

When the voltage reaches the operating threshold of the varistors V, the latter shunt the capacitor C. The current flowing in the varistors V is practically equal to that flowing in the resistor R.

After the high-speed transient condition, the voltage $U_S$ is applied to the resistor R, the varistors V and the capacitor C. The resistive current is then equal to $I_R = U_S/R$. The auxiliary switch is opened approximately 15 ms after the arc contacts are opened.

As the voltage $U_S$ approaches zero ($I_R$ and $U_S$ being in phase), the current $I_R$ falls rapidly towards zero at the time the current is interrupted by the varistors V, in other words approximately 50 microseconds before the voltage reaches zero volts.

The current between the arc contacts is therefore extremely low in the order of 0.5 A during the relaxation time $t_r = 2 \times 50$ μs either side of zero volts. At the line frequency the capacitance of the capacitor C is relatively high on the order of several hundred thousand ohms.

The auxiliary switch is able to turn off this very low current without any gas blast during this relaxation time interval of $2 \times 50$ μs.

Because SiC varistors have a low non-linearity coefficient, it is necessary to use six to ten elements in series to obtain an adequate relaxation time.

As can be seen on the graph, if the auxiliary switch is opened before the relaxation time tr1 it will turn off the current very quickly at the corresponding zero crossing of the voltage. If the auxiliary switch is opened after the relaxation time tr1 it will turn off the current at the next zero crossing of the voltage, at time tr2.

The most severe operating conditions for the switch are encountered with phases in opposition. The applied voltage is then equal to $2 \times U_S$ and the relaxation time is halved. Doubling or tripling the number of varistors in series doubles or triples the relaxation time.

In FIGS. 2, 4 or 5 two or three pads in series replace each element 42. The volume of the resistor R must be sufficient to withstand the thermal stresses during interruption of current in phase opposition. The volume of the resistor R is preferably greater than the volume of the varistors V by a factor of at least five.

The higher the capacitance of the capacitor C, the greater the residual current, during the relaxation time. For this reason, in the third or fourth embodiment FIGS. 5 and 6 a varistor 50 is connected in series with the capacitor 47. The varistor 50 is thin and has a relatively low peak operating voltage 1,000 volts, for example to facilitate turning off the current through the capacitor.

Figure 8:
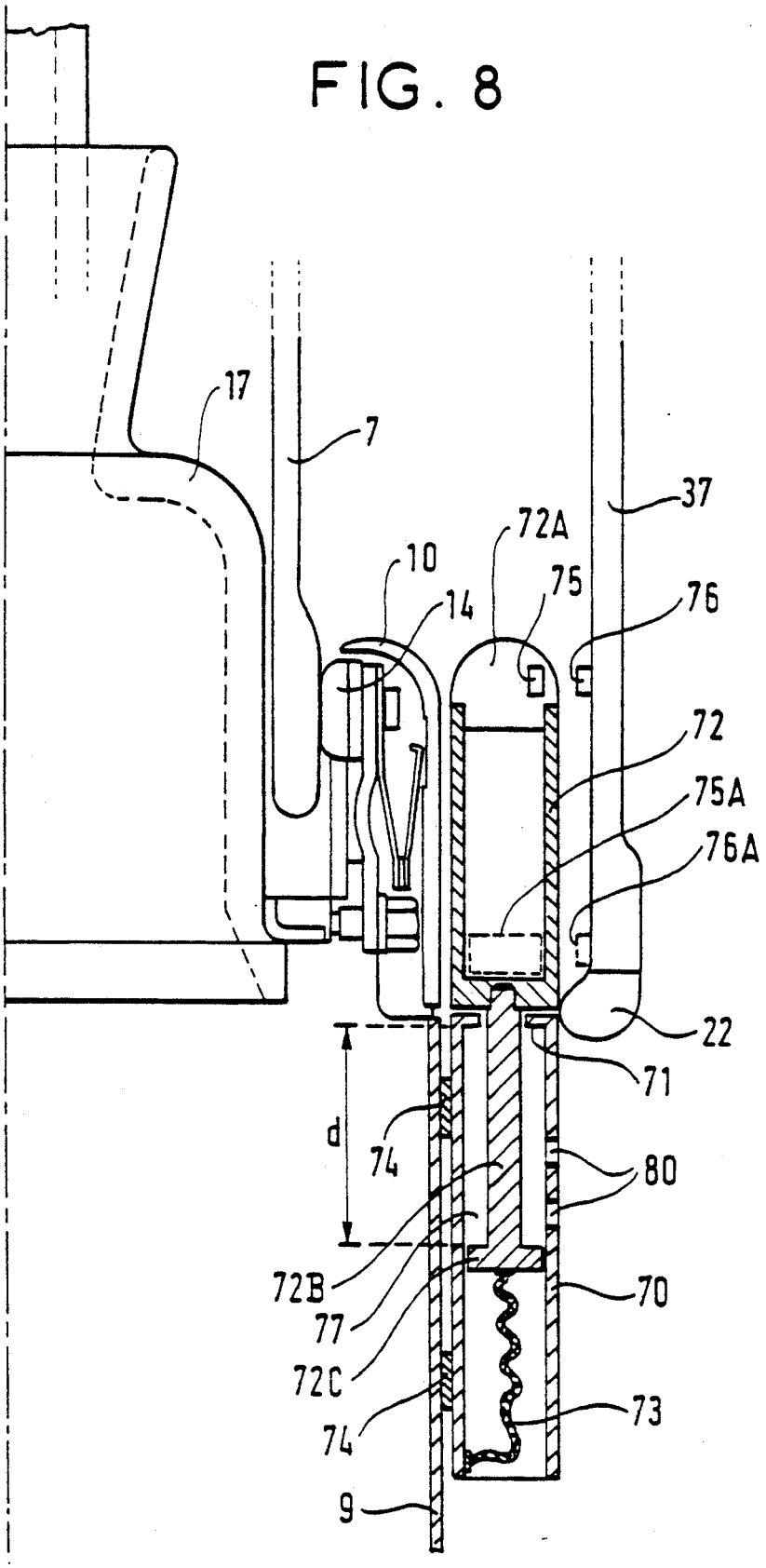
FIG. 8 shows one embodiment of the auxiliary switch.

FIG. 8 shows one embodiment of the auxiliary switch.

The arm 37 carries an electrode 22 which cooperates with a metal tube 70 delimiting a volume 77 and having a top cover 71 through which there is a hole; a metal member 72 having a head 72A, a stem 72B and an abutment 72C can move over a distance d facing the tube.

The height of the head 72A is such that it does not project from the cap 10 when the circuit-breaker is armed; the width of the tube 72 is such that the electrode 22 is in electrical contact with the tube and the head 72A during opening of the circuit-breaker. Holes 80 in the tube 70 prevent excessively fast compression of the gas in the volume 77 at the start of movement.

The member 72 is electrically connected by a braided conductor 73 to the tube 70 which is fixed mechanically and connected electrically to the tube 9, for example by brazed joints 74.

The head 72A may carry a magnet 75 which when the circuit-breaker is armed faces a magnet 76 carried by the arm 37. The head 72A may be made from mild steel. The magnets 75 and 76 may be replaced by magnets 75A and 76A.

Operation is as follows:

in the armed position, the resistor/varistor arrangement is short-circuited by the circuit-breaker contacts, on tripping, the mobile assembly moves downwards as seen in FIG. 8.

Because of the inertia and where applicable the attraction of the magnets, the member 72 remains immobile so that the period of contact between the electrode 22 and the tube 9 via the tube 70, the member 72 and the braided conductor 73 is extended as compared with that of the FIG. 1 embodiment by an amount representing the displacement d of the tube 9.

Between the time when the arc contacts 7 and 14 separate and the time the electrode 22 leaves the head 72A, the resistor/varistor arrangement is connected in parallel with the arc. At the end of the tripping maneuver the head 72A drops back onto the cover 71. A weak spring may be accommodated between the cover 71 and the abutment 72C to facilitate the return of the member 72 onto the cover 71 at the end of its travel.

When the circuit-breaker is closed, the tube 70 entrains the head 72A which touches the electrodes 22 so inserting the resistor/varistor assembly into the circuit before the arc contacts 14 and 7 come into contact.

To balance the device, a second inserter system identical to that just described is advantageously disposed symmetrically to the latter relative to the axis of the tube 9.

The invention applies to very high voltage circuit-breakers of the conventional insulated casing type or of the grounded metal casing type.

We claim:

1. High-voltage circuit-breaker comprising: an interrupting chamber constituted by a gas-tight cylindrical casing filled with a gas having good insulative properties such as sulfur hexafluoride, said chamber containing a fixed permanent contact and a fixed arc contact both connected to a first terminal and a mobile assembly comprising moving permanent contacts and moving arc contacts an gas blast means including a fixed piston within a movable tube bearing a gas blast nozzle at one end and about said arc contacts, said chamber also containing a carbon-based resistor having a resistance of approximately 500 ohms and an auxiliary switch connecting in parallel the resistor with the circuit-breaker contacts when said fixed and moving arc contacts are opened by said auxiliary switch, and wherein said auxiliary switch connects said resistor in series with an arrangement of varistors disposed inside said casing, and means responsive to opening of said circuit-breaker for opening said auxiliary switch, the volume of said resistor being greater than that of said arrangement of varistors by a factor of at least five, and wherein a capacitor having a capacitance of several thousand picofarads is connected in parallel with said arrangement of varistors.

2. Circuit-breaker according to claim 1 wherein said arrangement of varistors comprises varistors in parallel.

3. Circuit-breaker according to claim 2 wherein said arrangement of varistors comprise stacked varistor pads with groups of varistors separated by a conductive disk having a radial tab and said radial tabs are connected by a sheathed conductor.

4. Circuit-breaker according to claim 3 wherein a capacitor having a capacitance of several thousand picofarads is connected in parallel with said arrangement of varistors and said varistor pads and said conductive disks are annular.

5. Circuit-breaker according to claim 4 wherein an insulative tube is disposed in a hole formed by said stacked varistor pads and said capacitor is disposed in said hole and connected in parallel with said varistors by at least one conductor.

6. Circuit-breaker according to claim 1 wherein said arrangement of varistors comprises stacked SiC varistors in series.

7. Circuit-breaker according to claim 6 wherein a capacitor having a capacitance of several thousand picofarads is connected in parallel with said arrangement of varistors and said varistor pads are annular.

8. Circuit-breaker according to claim 7 wherein an insulative tube in disposed in a hole formed by said stacked varistor pads and said capacitor is disposed in said hole and connected in parallel with said varistors by at least one conductor.

9. Circuit-breaker according to claim 1 wherein a varistor is connected in series with said capacitor.

10. Circuit-breaker according to claim 1 wherein the auxiliary switch comprises at least one metal arm connected electrically to said resistor and engageable with an electrode carried by said metal tube connected electrically to a second terminal.

* * * * *